US008633367B2

(12) United States Patent
Steinhauser et al.

(10) Patent No.: US 8,633,367 B2
(45) Date of Patent: Jan. 21, 2014

(54) VARIABLE BEATER FOR DRUMS

(75) Inventors: Ruben Steinhauser, Altusried (DE); Winfried Holl, Illertissen-Au (DE)

(73) Assignee: GEWA music GmbH, Adorf (DE)

( * ) Notice: Subject to any disclaimer, the term of this patent is extended or adjusted under 35 U.S.C. 154(b) by 94 days.

(21) Appl. No.: 13/241,509

(22) Filed: Sep. 23, 2011

(65) Prior Publication Data

US 2012/0240746 A1 Sep. 27, 2012

(30) Foreign Application Priority Data

Mar. 16, 2011 (DE) ..... 10 2011 005 640

(51) Int. Cl.
*G10D 13/02* (2006.01)

(52) U.S. Cl.
USPC ..... 84/422.2

(58) Field of Classification Search
USPC ..... 84/422.1, 422.2, 422.3, 422.4
See application file for complete search history.

(56) References Cited

U.S. PATENT DOCUMENTS

| | | | | |
|---|---|---|---|---|
| 5,317,946 | A | 6/1994 | Hoshino | |
| 5,526,728 | A | 6/1996 | Behrenfeld | |
| 6,180,860 | B1 * | 1/2001 | Chen | 84/422.4 |
| 7,211,720 | B1 * | 5/2007 | Dorfman et al. | 84/422.1 |
| 2004/0221706 | A1 | 11/2004 | Gatzen | |

* cited by examiner

*Primary Examiner* — Kimberly Lockett

(57) ABSTRACT

The invention is directed to a beater for operating a drum, the beater comprising the following: a main body (10) having a beating part (11) which is removably attached to the main body (10); a shaft (20) on which the main body (10) is mounted, at least one recess (12) being formed in the main body (10) for accommodating a bulk body, wherein one side of the recess is delimited by a bottom surface (11*a*) of the beating part (11) so that the recess (12) is accessible from outside when the beating part (11) is removed. A pivot bearing of the main body (10) at the shaft (20) can be realized by a friction surface between the main body (10) and the shaft (20).

18 Claims, 3 Drawing Sheets

VARIABLE BEATER FOR DRUMS

CROSS-REFERENCE TO RELATED APPLICATIONS

This application claims priority and wholly incorporates by reference German application number DE 10 2011 005 640.8 filed on Mar. 16, 2011.

FIELD OF THE INVENTION

The invention is directed to a beater for big drums, especially for bass drums.

BACKGROUND

Beaters typically comprise a main body having a striking surface, as well as an elongate shaft to which the main body is attached. Such beaters are generally adapted for being joined at one end to a so-called "bass drum pedal". By means of the bass drum pedal, such beaters are operable to a rotational movement around an axis of the bass drum pedal by a foot of a player in order to generate a striking movement.

The function of such a beater consists in inducing vibrations into a drum head of a big drum, especially a bass drum, by making the striking surface of the beater strike the drum head and thereby generate a sound. In this regard, several parameters are decisive for the sound characteristics:

1. the kinetic energy applied to the drum by means of the beater, wherein the kinetic energy can be influenced by the weight/mass of the beater (heavy weight—high sound level—rich sound; small weight—shallow sound);
2. the dimension of a struck area of the drum (a small stricken area results in a "slower" build-up of the sound, whereas a larger stricken area results in a more explosive reaction of the resonating body);
3. the hardness of the striking surface of the beater, wherein a hard striking surface produces a high proportion of harmonics and a well-defined impact, whereas a soft striking surface results in a low proportion of harmonics and in a soft impact.

In order to be able to vary the parameter of the applied kinetic energy, it is known to provide additional bulk elements, which are mounted on the surface of the main body of the beater. Moreover, it is known to provide an additional bulk element in the form of a cylinder having a central bore through which the shaft of the beater passes, so that the cylinder is displaceable on the shaft. By means of the displacement, a change of the position of the bulk element and therefore a change of the momentum induced by the bass drum pedal are achieved.

However, the last mentioned solution has the disadvantage that, for replacing a cylinder, either the beater has to be removed from the bass drum pedal or the main body of the beater has to be dismounted from the shaft. As to the first mentioned solution, the mounting of the bulk elements on the surface of the main body allows only for relatively flat bulk elements, since otherwise the diameter of the main body would be enlarged, and the main body would tend to be more bulky.

In order to achieve a good sound quality, it is further decisive that the striking surface of the beater strikes the drum head of the drum in parallel. For this, it is necessary to be able to vary an angle between the main body and the shaft of the beater, so that, if, for example, there is a change of a distance between the bass drum pedal and the drum which leads to a change of the point of impact and therefore to a change of the impact angle (strike angle) between the striking surface and the drum head, the angle between the main body and the shaft can be adapted so that the striking surface strikes the drum head of the drum in parallel again.

From U.S. Pat. No. 7,211,720 B1, there is known a beater for a bass drum according to which a shaft of the beater passes through a bore in a main body, wherein the bore is designed so that there is a certain clearance so that an angle between the main body and the shaft can be adjusted within a small range. There is provided a fastening screw for fixing a set angular position of the main body with regard to the shaft by turning the screw.

A similar possibility of variation of an angle between a main body and a shaft is described in U.S. Pat. No. 5,317,946. In the case described therein, there is provided an axis running perpendicularly to the shaft of the beater, wherein the main body is rotatable around the axis, if a threaded bolt is unscrewed, which threaded bolt causes clamping of the main body to the axis when tightened. In order to fix a set angular position, the threaded bolt must be tightened.

However, in each of the cases mentioned above, a mechanic clamping has to be released before the angle between main body and shaft can be changed.

SUMMARY OF THE INVENTION

It is an object of the present invention to provide a beater for operating a big drum, especially a bass drum, which allows varying and optimizing, respectively, the sound quality by simple means.

This object is achieved by a beater according to the embodiments of the present invention. Further developments are also described.

A beater for operating a drum according to one embodiment of the invention comprises: a main body having a beating part which is removably attached to the main body; a shaft on which the main body is mounted, wherein at least one recess is formed in the main body for accommodating a bulk body, and wherein one side of the recess is delimited by a bottom surface of the beating part so that the recess is accessible from outside when the beating part is removed.

The recess provides for a safe support for replaceable bulk bodies which serve for increasing a self-weight of the beater. By use of bulk bodies having different weights, a sound of a drum excited by the beater can be varied, as mentioned above. When choosing the bulk bodies, it has to be taken into consideration that a higher weight results in a higher volume and a richer sound, also known as "punch", but is more difficult to control in terms of foot feeling when operating a corresponding bass drum pedal.

Due to the fact that the bulk bodies are accommodated in the at least one recess within the main bodies, they bring about only a slight increase of a diameter of the main body or even no increase at all, and therefore, the outer dimensions of the beater will not substantially change. Furthermore, the bulk bodies are supported within the main body in a safe manner, wherein the bulk bodies are secured against being displaced after mounting of the beating part which closes the at least one recess towards one side.

According to one embodiment, the beating part is removably attached to the main body by means of a screw thread. This means that the beating part can easily be screwed onto the main body or unscrewed from the main body. In this manner, on the one hand, there is provided a very safe connection between the main body and the beating part, and on the other hand, the connection can be readily undone. According to an alternative, it is also possible to provide, for example, a plug-and-socket connection having a snap fit or the like, for the removable attachment of the beating part to the main body. In this connection, it is important that access to the recess and the recesses, respectively, within the main body is manually possible without use of a tool.

As already mentioned, there can be provided several recesses within the main body. In order to provide for a good playability, it is advantageous in this case, if the recesses are positioned equally spaced in a circumferential direction within the main body. In this manner, the weight is distributed over a striking surface as evenly as possible, which striking surface constitutes an outer boundary surface of the beating part.

Said embodiment is advantageous insofar as, with a single operation, the removal of the beating part, all recesses may be charged at the same time and then secured in position by reattachment of the beating part. This is in contrast to the state of the art mentioned above according to which the single weights and bulk bodies, respectively, have to be mounted on an outer surface of the main body and each bulk body has to be fixed individually.

According to one embodiment, four recesses are formed in the main body. Those recesses are arranged offset from each other by 90° within the main body. With this arrangement, on the one hand, the number of bulk bodies that can be accommodated is small, and on the other hand, a very even load distribution on the beating head is achieved.

According to a further embodiment, at least one opening can be formed in the main body, which opening connects the at least one recess to the outside, even when the beating part is attached. In other words, a bulk body accommodated in the recess of the main body can be made visible from outside through the at least one opening. This is advantageous due to the fact that it is recognizable from outside whether or not a bulk body is accommodated in the recess and which kind of bulk body is accommodated, respectively. If a bulk body accommodated in the recess is provided with an indication as to its weight, for example on its outer surface, a total weight of the beater can be determined directly, i.e. without removing the beating part from the main body.

The invention is further directed to a beater unit comprising at least a beater as described above and at least one bulk body accommodated in the recess. The bulk body/the bulk bodies and the beater itself thus form a unit.

The bulk body may have, for example, a cylindrical shape. This is advantageous for the convenience of insertion, because due to a rotational symmetry of the cylinder, an angular position does not have to be taken into account when inserting the bulk body. Of course, also other shapes of bulk bodies can be taken into account, for example cubes, cuboids or bar-shaped bulk bodies.

According to a further arrangement, it is possible that the at least one bulk body protrudes to the outside through the at least one opening. In this case, the visibility mentioned above is particularly accomplished.

In order to avoid that a bulk body slides within the recess in which it is accommodated, which would impair the operatability of the beater and thus the playing quality, each recess may be provided with an elastic damping element urging the bulk body accommodated therein against a periphery of the recess. Also several elastic damping elements can be provided in each recess, if applicable, in order to maintain a pressure in different directions. In this manner, vibrations caused by sliding of the bulk body within the recess when being played are avoided.

An arrangement according to which each recess is dimensioned so that the bulk body inserted therein is accommodated in a positive fitting manner, has similar effects as mentioned above. This means that the shape of the recess corresponds partly or fully to the shape of the bulk body inserted therein. Such an arrangement includes the advantage that no mistakes can be made when inserting the bulk bodies into the recess, even if the insertion is made in a cursory manner, for example under time pressure.

According to a further embodiment of the invention, a beater for operating a drum comprises the following: a main body having a beating part which is removably attached on the main body; a shaft on which the main body is pivoted, a pivot bearing being realized by a friction surface between the main body and the shaft, a friction force being set so that the main body remains in a preset angular position, if no outer force acts on it, whereas the friction force can be overcome by rotating the main body by hand.

Due to the feature combination mentioned above, changes of a distance between a bass drum pedal in which the beater is inserted, and a drum which is operated by means of the beater, can be compensated for. Due to the fact that the friction force is dimensioned as described above, it is ensured that the main body does not pivot in relation to the shaft already due to its proper weight. On the other hand, it is ensured that, if an angle between the main body and the shaft is set so that the striking surface of the beating part does not strike the drum head of a drum to be played in parallel, the main body adjusts itself automatically when first striking the drum. In other words, according to the present invention an automatic adjustment of the angle between the main body and the shaft corresponding to the distance to the drum is made possible without the necessity of a corresponding manual adjusting by the player.

In this manner, it is achieved that the striking surface of the beating part of the beater is always in parallel with a respective drum head of a drum, whereby it is possible to obtain an optimal sound quality, since the whole striking surface of the beater is utilized for playing. Furthermore, also the lifetime of a played drum is increased due to the fact that, if, during playing, the beating part strikes the drum head of the drum in a position in which the striking surface of the beating part is not in parallel with the drum head of the drum, the drum heat experiences a higher and more unilateral stress due to a higher concentrated load.

The friction surface can be formed by a surface of an axis which runs orthogonally with regard to the shaft through the main body. The axis is firmly connected to the shaft, whereas the main body can carry out a pivotal movement around the axis which leads to a change of the angle between the shaft and the main body. In contrast to the state of the art, that angle does not have to be fixed manually by exerting a clamping force, for example by means of screwing of threaded bolts.

The axis may be formed, for example, as a cylinder having a diameter which is larger than the diameter of the shaft, one end of the shaft being accommodated in the cylinder. In this arrangement, the generated surface of the cylinder can be used as friction surface between the main body and the shaft, wherein the friction force can be set according to the requirements mentioned above.

The embodiments lead to easy operability of a corresponding beater, wherein a greater variability in terms of use can be achieved.

Further features and advantages of the invention will become apparent from the following description, with reference to the accompanying drawings.

DETAILED DESCRIPTION OF THE INVENTION

Figure 1A:
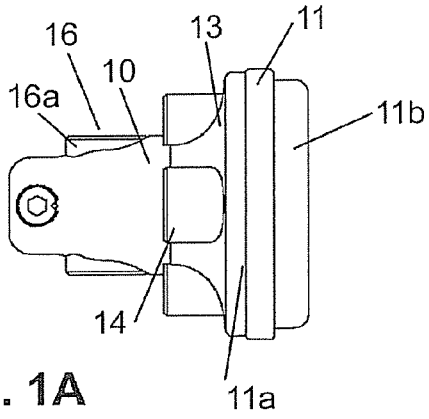
FIGS. 1A to 1D are a plan view (FIG. 1A), a perspective view (FIG. 1B), a front sectional view (FIG. 1C), and a side sectional view (FIG. 1D) of a drum beater, respectively, according to an embodiment of the invention.
Figure 1B:
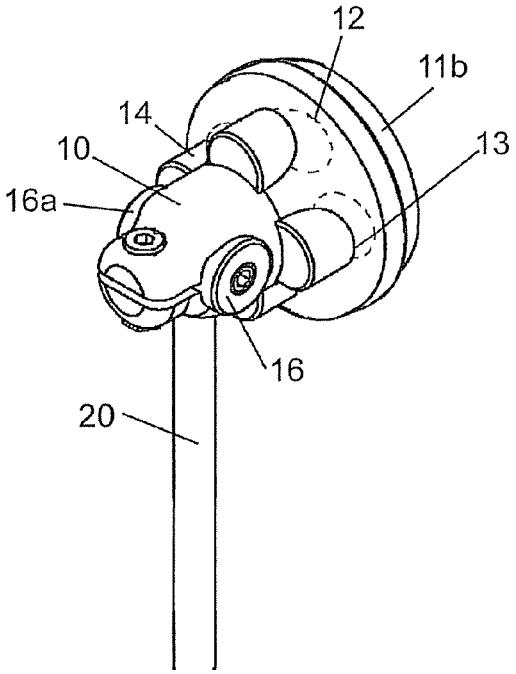

FIGS. 1A to 1D show an embodiment of a beater for operating a big drum, especially a bass drum, according to the present invention. As it is shown in FIGS. 1A and 1B, the beater comprises a main body 10 having a beating part 11 which can be attached manually to the main body 10, for example by screwing. The beating part 11 comprises a bottom surface 11*a* which faces the main body 10, and a striking surface 11*b* which is designed to strike the drum head of a drum (not shown) when the drum is played.

Figure 1C:
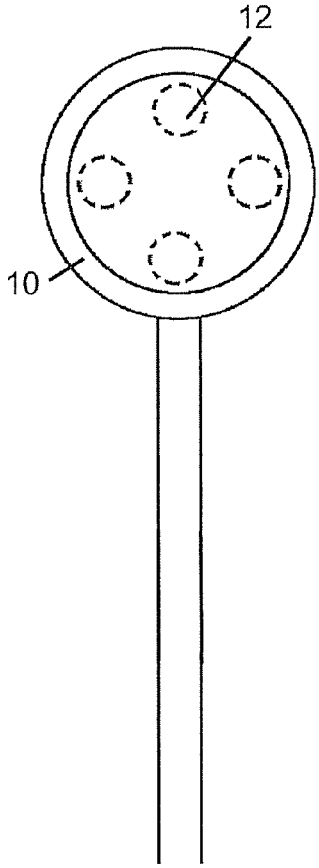

As this can be especially recognized from FIG. 1C, the main body 10 is provided with recesses 12. The recesses 12 are delimited to a front side by the bottom surface 11*a* (not shown in FIG. 1C) of the beating part. Furthermore, in the views of FIGS. 1A, 1B and 1D, there can be recognized openings 13 by which the recesses 12 are connected to the outside even in case the beating part 11 is attached and screwed on, respectively, as it is shown in the drawings. Bulk bodies 14 inserted in the main body 10 of the beater can be viewed from outside through those openings 13. As this can be seen, the bulk bodies 14 are accommodated in the recesses 12 in a positive fitting manner.

Figure 1D:
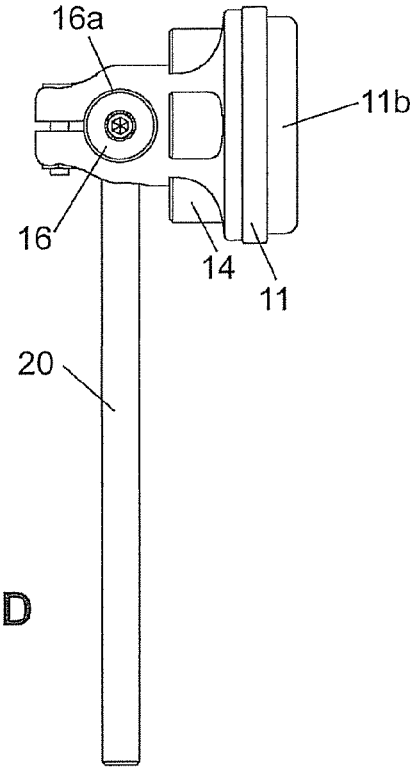

For insertion of the bulk bodies 14, the beating part 11 is removed, for example by being unscrewed, so that access to the main body 10 and the recesses 12 formed therein is achieved. Then, the bulk bodies 14 which are cylindrically shaped here, can be readily inserted into the recesses 12 without use of a tool, until they reach the position which is shown in FIGS. 1A, 1B and 1D. In the following, the beating part 11 can be attached and screwed, respectively, to the main body again. On the one hand, the bulk bodies 14 are safely contained in the recesses 12, and on the other hand, they are visible from outside through the openings 13.

Provided that there is a set of four bulk bodies in the example shown, there are five possibilities of varying the total weight of the beater: use of the beater without a bulk body being inserted (low total weight) and selective insertion of one, two, three or four bulk bodies (increasing total weight). These configurations are exemplary only. Other configurations, such as ones with five, six or seven bulk bodies, for example, are also possible.

Elastic damping elements 15 (not shown in FIGS. 1A to 1D) may be contained in the recesses in order to keep the bulk bodies 14 urged against a periphery of the recesses 12 and thus avoid vibration of the bulk bodies when the beater hits the drum head of a drum.

Due to the possibility of removing the beating part 11 (in the above embodiment, for example, by unscrewing), it is possible to replace the beating part and use beating parts having different striking surfaces 11*b*, for example made from rubber, felt, wood or ABS resin/ABS rubber. In this manner, the sound quality can again be varied. This is possible without use of tools.

A further advantage is achieved, if, as it is shown in FIGS. 1A, 1B and 1D, the main body 10 is connected to the shaft 20 through an axis 16 which is formed in the shape of a cylinder here, a surface 16*a* of the axis 16 and the cylinder, respectively, constituting a friction surface for a pivotal movement of the main body 10 relative to the shaft 20.

Figure 2A:
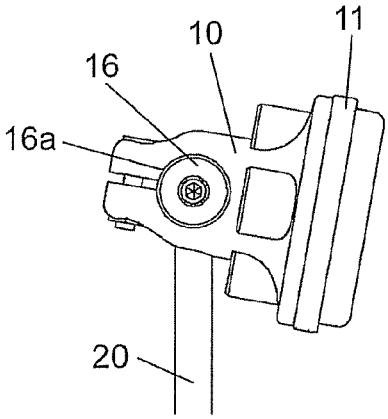
FIGS. 2A and 2B show the drum beater of FIG. 1 in different tilt positions of the main body relative to the shaft, according to an embodiment of the invention.
Figure 2B:
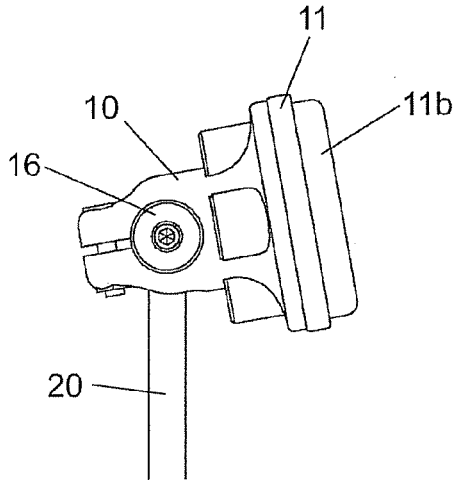

In FIGS. 2A and 2B, two possible pivot positions of the main body 10 relative to the shaft 20 through the axis 16 are shown. The friction force of the friction surface (surface 16*a*) on the axis 16 is set so that any of the shown angular positions is a stable one in the absence of any outer mechanical forces. In other words, there is no necessity for a clamping means in order to keep the main body in one of the positions shown (or in any other position). If, however, the shown beater strikes a drum (not shown), so that the striking surface 11*b* of the beating part 11 is not in parallel with the drum head of the drum, a momentum is exerted on the main body 10 relative to the axis 16 at a point of contact between the striking surface 11*b* of the beating part 11 and the drum head of the drum. This results in an automatic adjustment of the main body 10 so that the striking surface 11*b* hits the drum head of the drum again in parallel at the next beat. Thus, the striking surface automatically aligns in order to compensate for a changing distance of a bass drum pedal on which the beater is mounted, to the drum.

Figure 3:
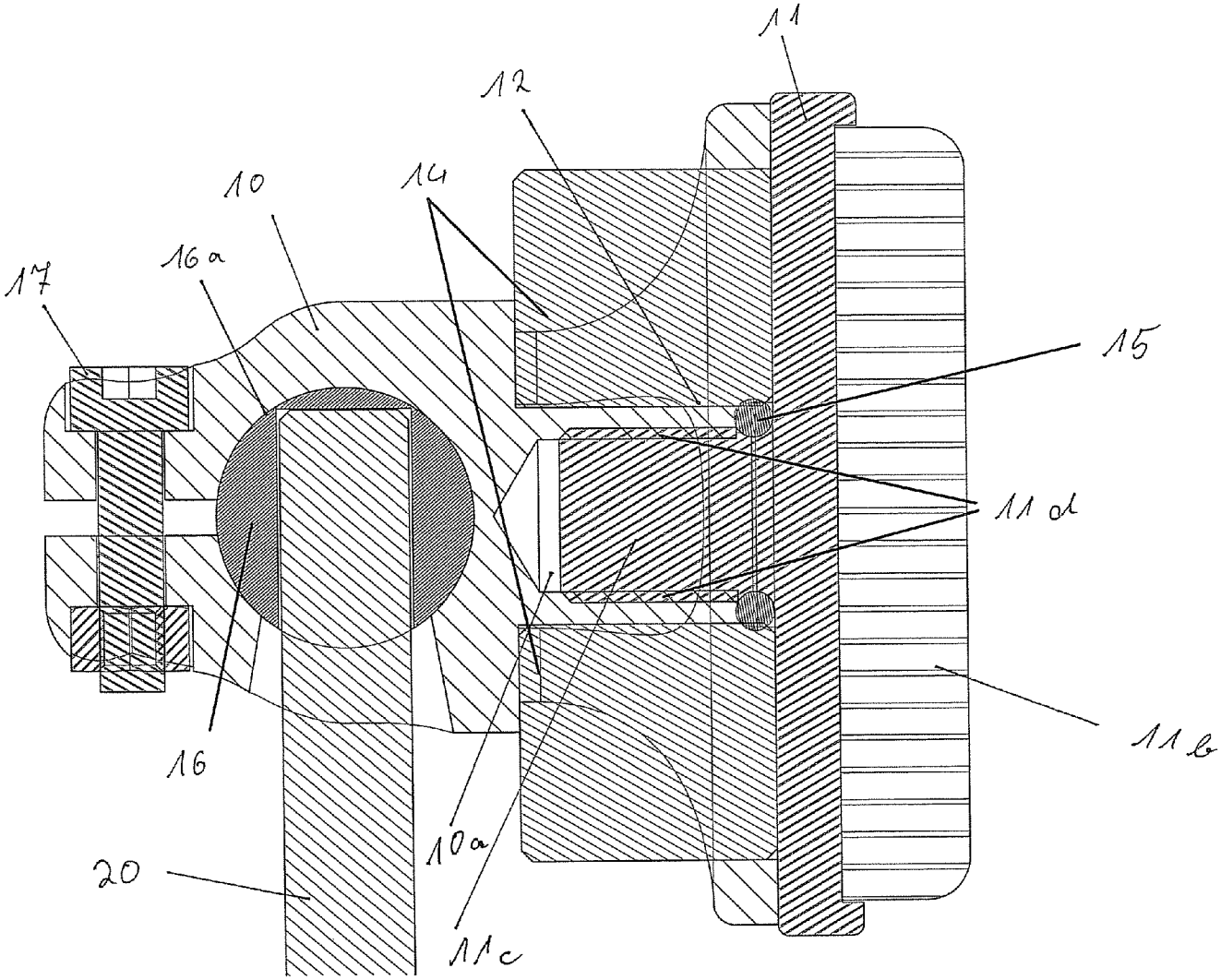
FIG. 3 is a lateral sectional view through the drum beater depicted in FIGS. 1 and 2, according to an embodiment of the invention.

With reference to FIG. 3, there is shown a sectional view through a beater unit having a beater according to the embodiment previously shown. In this connection, it has to be mentioned that a fastening screw 17 which is shown here, in order to keep two branches of the main body 10 together, is not designed for pressing the branches together so that a wedge effect is exerted on the axis 16 (cylinder). Rather, stability of a set angular position between the main body 10 and the shaft 20 is achieved only by a friction force between the surface 16*a* of the axis 16 and the main body 10.

In the drawing, there can readily be recognized a position of the bulk bodies 14 within the recesses 12. As this is shown, the bulk bodies 14 are accommodated within the recesses 12 in a positive fitting manner, wherein an additional elastic damping element 15, here in the shape of an O-ring, for example from rubber, provides for avoiding vibration of the bulk bodies 14. With other words, the elastic damping element 15 compensates for slighter dimensional tolerances between the recesses 12 and the bulk bodies 14. Furthermore, it can be recognized from that figure that the beating part 11 comprises a stud 11*c* for being detachably mounted to the main body 10, a thread 11*d* being formed on the stud 11*c*. In this manner, the stud 11*c* of the beating part 11 can be screwed into a recess 10*a* of the main body 10 provided with a counter thread. As this can be seen, the striking surface 11*b* itself can be made from a different material than the rest of the beating part 11, for example from felt, rubber, wood or ABS resin, depending on the desired sound quality.

It is to be mentioned that the features of the pivot movement of the main body relative to the shaft damped by the frictional force, and the recesses 12 accessible by the removable beating part 11 can be realized independently from each other.

The invention claimed is:

1. A beater for operating a drum, comprising: a main body having a beating part which is removably attached to the main body; a shaft on which the main body is mounted, characterized in that at least one recess is formed in the main body for accommodating a bulk body to vary the total weight of the beater, wherein one side of the recess is delimited by a bottom surface of the beating part so that the recess is accessible from outside when the beating part is removed.

2. The beater of claim 1, wherein the beating part is removably attached to the main body by means of a screw thread.

3. The beater of claim 1, wherein several recesses are formed within the main body, which recesses are positioned equally spaced in a circumferential direction.

4. The beater of claim 1, wherein four recesses are formed in the main body.

5. The beater of claim 1, wherein at least one opening is formed in the main body, which opening connects the at least one recess to the outside, even when the beating part is attached.

6. A beater unit comprising the beater of claim 1, and a bulk body accommodated in the at least one recess.

7. The beater unit as claimed in claim 6, wherein the at least one bulk body has a cylindrical shape.

8. The beater unit of claim 6, wherein the at least one bulk body protrudes partially to the outside through the at least one opening.

9. The beater unit of claim 6, wherein each recess is provided with an elastic damping element urging the bulk body accommodated therein against a periphery of the recess.

10. The beater unit of claim 6, wherein each recess is dimensioned so that the bulk body inserted therein is accommodated in a positive fitting manner.

11. A beater for operating a drum, comprising: a main body having a beating part which is removably attached to the main body; a shaft on which the main body is pivoted, characterized in that a pivot bearing is realized by a friction surface between the main body and the shaft, the friction force being set so that the main body remains in a preset angular position, if no outer force acts on it, whereas the friction force can be overcome by rotating the main body by hand.

12. The beater of claim 11, wherein a friction surface is formed by a surface of an axis, the axis running orthogonally with regard to the shaft through the main body.

13. The beater of claim 12, wherein the axis is formed as a cylinder having a diameter which is larger than a diameter of the shaft, one end of the shaft being accommodated in the cylinder.

14. A beater unit comprising a beater for operating a drum, the beater comprising:

a main body having a beating part which is removably attached to the main body;

a shaft on which the main body is mounted, characterized in that at least one recess is formed in the main body for accommodating a bulk body to vary the total weight of the beater, wherein one side of the recess is delimited by a bottom surface of the beating part so that the recess is accessible from outside when the beating part is removed;

the beater unit also comprising a bulk body accommodated in the at least one recess.

15. The beater unit as claimed in claim 14, wherein the at least one bulk body has a cylindrical shape.

16. The beater unit as claimed in claim 14, wherein the at least one bulk body protrudes partially to the outside through the at least one opening.

17. The beater unit as claimed in claim 14, wherein each recess is provided with an elastic damping element urging the bulk body accommodated therein against a periphery of the recess.

18. The beater unit as claimed in claim 14, wherein each recess is dimensioned so that the bulk body inserted therein is accommodated in a positive fitting manner.

* * * * *